US008385756B2

(12) United States Patent
Yamashina et al.

(10) Patent No.: US 8,385,756 B2
(45) Date of Patent: Feb. 26, 2013

(54) FAILURE DIAGNOSIS DEVICE, FAILURE DIAGNOSIS METHOD, IMAGE FORMING DEVICE, AND RECORDING MEDIUM

(75) Inventors: Ryota Yamashina, Kanagawa (JP); Yasushi Nakazato, Tokyo (JP); Osamu Satoh, Kanagawa (JP); Kohji Ue, Kanagawa (JP); Mikiko Imazeki, Kanagawa (JP); Masahide Yamashita, Tokyo (JP); Jun Yamane, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 235 days.

(21) Appl. No.: 12/871,283

(22) Filed: Aug. 30, 2010

(65) Prior Publication Data

US 2011/0052224 A1 Mar. 3, 2011

(30) Foreign Application Priority Data

Sep. 1, 2009 (JP) ..... 2009-201312

(51) Int. Cl.
*G03G 15/20* (2006.01)

(52) U.S. Cl. ..... 399/33; 399/36

(58) Field of Classification Search ..... 399/33, 399/36, 122

See application file for complete search history.

(56) References Cited

U.S. PATENT DOCUMENTS

| | | | |
|---|---|---|---|
| 7,110,917 | B2 | 9/2006 | Matsuura et al. |
| 7,184,674 | B2 | 2/2007 | Satoh et al. |
| 7,203,431 | B2 | 4/2007 | Shoji et al. |
| 7,327,962 | B2 | 2/2008 | Shoji et al. |
| 7,539,599 | B2 | 5/2009 | Hasegawa et al. |
| 7,554,574 | B2 | 6/2009 | Shoji et al. |
| 2005/0248801 | A1 | 11/2005 | Miyahara et al. |
| 2005/0281596 | A1 | 12/2005 | Nakagawa et al. |
| 2006/0294252 | A1 | 12/2006 | Shoji et al. |
| 2007/0258723 | A1 | 11/2007 | Nakazato et al. |
| 2007/0292146 | A1 | 12/2007 | Takesue et al. |
| 2008/0068639 | A1 | 3/2008 | Satoh et al. |
| 2008/0075476 | A1 | 3/2008 | Nakazato et al. |
| 2008/0199193 | A1 | 8/2008 | Nakazato et al. |
| 2009/0033993 | A1 | 2/2009 | Nakazato et al. |
| 2009/0034990 | A1 | 2/2009 | Nakazato et al. |
| 2009/0052912 | A1 | 2/2009 | Soji et al. |
| 2009/0190939 | A1 | 7/2009 | Satoh et al. |
| 2009/0196634 | A1 | 8/2009 | Satoh et al. |
| 2009/0319827 | A1 | 12/2009 | Nakazato et al. |
| 2009/0322524 | A1 | 12/2009 | Nakazato et al. |
| 2009/0324259 | A1 | 12/2009 | Ue et al. |
| 2010/0094594 | A1 | 4/2010 | Yamashita et al. |

FOREIGN PATENT DOCUMENTS

| | | |
|---|---|---|
| JP | 6-208265 | 7/1994 |
| JP | 2005-309077 | 11/2005 |
| JP | 2008-102474 | 5/2008 |

OTHER PUBLICATIONS

U.S. Appl. No. 12/818,564, filed Jun. 18, 2010, Kohji Ue et al.
U.S. Appl. No. 12/822,586, filed Jun. 24, 2010, Mikiko Imazeki et al.

*Primary Examiner* — Hoang Ngo
(74) *Attorney, Agent, or Firm* — Oblon, Spivak, McClelland, Maier & Neustadt, L.L.P.

(57) ABSTRACT

A first feature quantity computing unit that computes a first feature quantity representing an average of a plurality of driving loads recorded by a driving load of a fixing section recording unit of an image forming device that records the driving load acquired by a driving load acquiring unit that acquires the driving load, a second feature quantity computing unit that computes a second feature quantity representing a deviation of the plurality of the driving loads, and a diagnosis unit that performs failure diagnosis including estimation of a cause of a failure of the fixing section using the first feature quantity and the second feature quantity are used.

9 Claims, 7 Drawing Sheets

FAILURE DIAGNOSIS DEVICE, FAILURE DIAGNOSIS METHOD, IMAGE FORMING DEVICE, AND RECORDING MEDIUM

CROSS-REFERENCE TO RELATED APPLICATIONS

The present application claims priority to and incorporates by reference the entire contents of Japanese Patent Application No. 2009-201312 filed in Japan on Sep. 1, 2009.

BACKGROUND OF THE INVENTION

1. Field of the Invention

The present invention relates to a failure diagnosis device and a failure diagnosis method for a failure of an image forming device such as a copy machine, a printer, and a facsimile, particularly, a failure of a fixing section, an image forming device in which the failure is diagnosed by the failure diagnosis device or the failure diagnosis method, and a computer program product comprising a computer-usable medium having computer-readable program codes embodied in the medium for executing the failure diagnosis method.

2. Description of the Related Art

An image forming device such as a copy machine, a printer, and a facsimile includes a number of units or components. When abnormality occurs in the image forming device due to a failure or the end of life of the unit, etc., it is necessary to perform repair or maintenance such as replacement. Some or all functions of the image forming device need to be stopped while the repair is performed. In performing the repair, it may take a long time to find out a cause of abnormality, and thus there is a problem in that a user is inconvenienced because it is impossible to use the image forming device during that time in addition to a net time of repair or the like. This problem also occurs when the maintenance on a portion in which abnormality is likely to occur is performed before abnormality occurs. In order to solve the problem, it is required to diagnose where abnormality of the image forming device occurs or is likely to occur to perform the maintenance, etc., thereby reducing downtime.

In this regard, a technique for estimating a failure portion (for example, see Japanese Patent Application Laid-open No. 06-208265), a technique for extracting a candidate of a failure portion or a portion that is likely to cause a failure (for example, see Japanese Patent Application Laid-open No. 2005-309077), and a technique for determining whether or not a device is in an abnormal state or anticipating an occurrence of a failure in a device (for example, see Japanese Patent Application Laid-open No. 2008-102474) have been suggested.

Meanwhile, as one of constitutions disposed in the image forming device, a fixing section has a larger number of components in general and is relatively higher in cost than other constitutions. Since the fixing section has a larger number of components, various causes may be considered as a cause of its trouble or its failure. Therefore, the same problem as the problem described above, for example, a problem in that a time taken for maintenance tends to become longer and unnecessary maintenance may be performed for a portion different from a cause is exactly applied to the fixing section. Consequently, similarly, in order to solve the problem in the fixing section, it is important to diagnose where abnormality of the fixing section occurs or is likely to occur to perform the maintenance, thereby reducing downtime.

In this regard, the applicant previously suggested a failure diagnosis device that performs failure diagnosis of a fixing section disposed in an image forming device including estimation of a cause of trouble related to a paper transport time in the fixing section in Japanese Patent Application No. 2009-163382.

However, since trouble in the fixing section is not caused only in connection with the paper transport time, it is required to additionally suggest a technique for being capable of dealing with other causes of trouble.

SUMMARY OF THE INVENTION

It is an object of the invention to at least partially solve the problems in the conventional technology.

According to an aspect of the present invention there is provided a failure diagnosis device for a failure of a fixing section of an image forming device. The failure diagnosis device includes: a first feature quantity computing unit that computes a first feature quantity representing an average of a plurality of driving loads of the fixing section recorded by a driving load recording unit that records the driving load acquired by a driving load acquiring unit that acquires the driving load; a second feature quantity computing unit that computes a second feature quantity representing a deviation of the plurality of the driving loads recorded by the driving load recording unit; and a diagnosis unit that performs failure diagnosis including estimation of a cause of the failure of the fixing section using at least the first feature quantity computed by the first feature quantity computing unit and the second feature quantity computed by the second feature quantity computing unit. According to another aspect of the present invention there is provided a failure diagnosis method for a failure of a fixing section of an image forming device. The failure diagnosis method includes: computing, by a first feature quantity computing unit, a first feature quantity representing an average of a plurality of driving loads of the fixing section recorded by a driving load recording unit that records the driving load acquired by a driving load acquiring unit that acquires the driving load; computing, by a second feature quantity computing unit, a second feature quantity representing a deviation of the plurality of the driving loads recorded by the driving load recording unit; and performing, by a diagnosis unit, failure diagnosis including estimation of a cause of the failure of the fixing section using at least the first feature quantity computed by the first feature quantity computing unit and the second feature quantity computed by the second feature quantity computing unit. The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
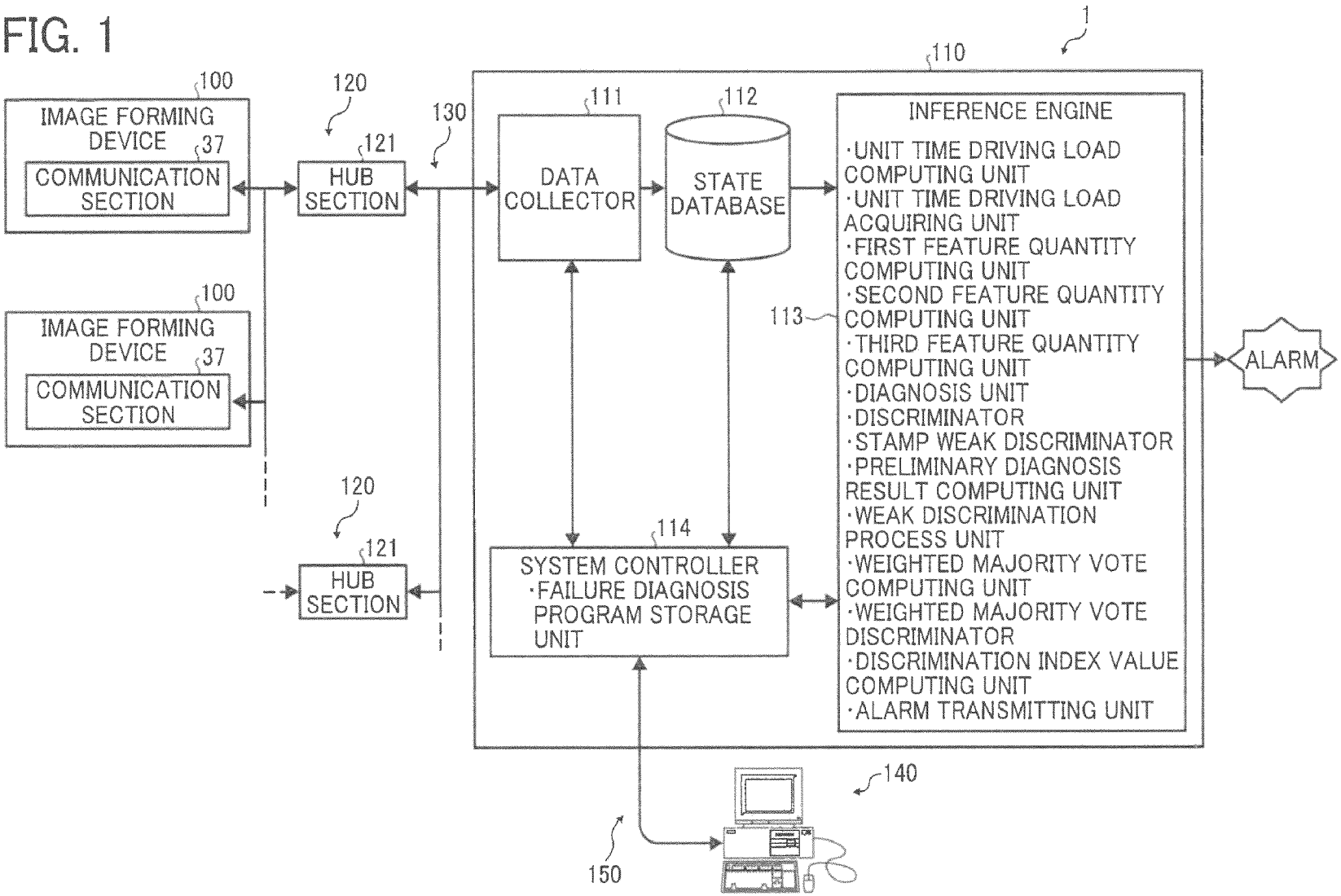
FIG. 1 is a control block diagram illustrating an overview of a failure diagnosis device according to the invention.

FIG. 1 schematically illustrates a failure diagnosis system according to the invention.

The failure diagnosis system 1 includes a failure diagnosis device 110 to which the invention is applied, a plurality of image forming devices 100 that are failure diagnosis targets of the failure diagnosis device 110, a plurality of Local Area Networks (LANs) 120, as a first network, that each connect the image forming devices 100 within a predetermined area among the plurality of image forming devices 100 with each other, and the Internet 130, as a second network, that connects the plurality of LANs 120 with the failure diagnosis device 110.

The failure diagnosis system 1 further includes a personal computer (PC) 140 that is a terminal as an operation terminal operated by an operator such as an administrator who performs operation and maintenance management on the failure diagnosis device 110 maintenance management on the image forming devices 100, etc., and a LAN 150 that is a third network that connects the failure diagnosis device 110 with the PC 140.

The failure diagnosis device 110 is configured as a server for the PC 140. The details of the failure diagnosis device 110 will be described later.

The LAN 120 includes a HUB section 121 that is connected not only with the image forming device 100 but also with the Internet 130. The LAN 120, the HUB section 121, and the Internet 130 are not indispensable and may be appropriately combined. For example, the image forming devices 100 may be connected directly with the Internet 130 or with the failure diagnosis device 110, or the LAN 120 may be connected directly with the failure diagnosis device 110. The LAN 120 and the LAN 150 may be the same one.

Figure 2:
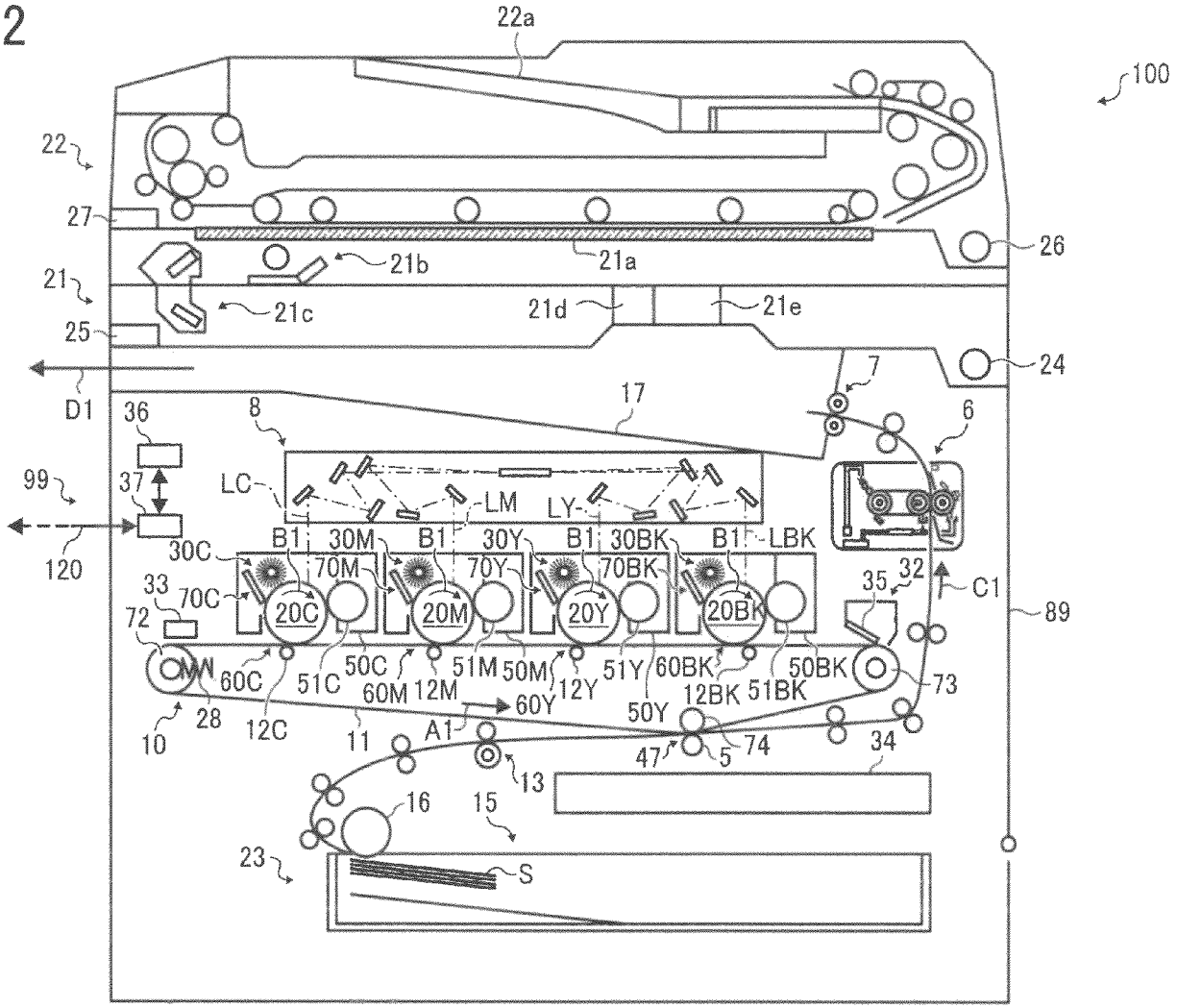
FIG. 2 is a schematic front view illustrating an image forming device illustrated in FIG. 1.

FIG. 2 illustrates an overview of the image forming device 100. The image forming device 100 is a complex machine of a copy machine, a printer, and a facsimile and is configured to perform full-color image forming. When used as a printer and a facsimile, the image forming device 100 performs an image forming process based on an image signal corresponding to image information received from the outside via the LAN 120, a telephone line, etc.

The image forming device 100 can form an image on a sheet-like recording medium, which may be a transferred material or a recording paper, including a thick paper such as an OHP sheet, a card, and a postcard, and an envelop as well as a regular paper generally used for copying purposes or the like.

The image forming device 100 is a color image forming device of a tandem system or a tandem type that employs a tandem structure in which cylindrical drum-shaped photosensitive elements 20BK, 20Y, 20M, and 20C, which are latent image carriers as image carriers that can form images respectively corresponding to colors decomposed into colors of yellow, magenta, cyan, and black, are disposed in tandem.

The photosensitive elements 20BK, 20Y, 20M, and 20C have the same diameter and are disposed in tandem at an equal interval on an outer circumferential surface side, i.e., an image formed surface side of a transfer belt 11 as an intermediate transfer belt corresponding to an intermediate transfer body that is an endless belt disposed at substantially a center inside a main body 99 of the image forming device 100. The transfer belt 11 is movable in a direction of an arrow A1 while confronting the photosensitive elements 20BK, 20Y, 20M, and 20C.

The photosensitive elements 20BK, 20Y, 20M, and 20C are arranged in tandem in this order from an upstream side of the A1 direction. The photosensitive elements 20BK, 20Y, 20M, and 20C are disposed in image stations 60BK, 60Y, 60M, and 60C that are image forming unit corresponding to image forming sections as sections for forming images of black, yellow, magenta, and cyan, respectively.

Visible images, i.e., toner images formed on the photosensitive elements 20BK, 20Y, 20M, and 20C are transferred onto the transfer belt 11 that moves in the arrow A1 direction in a superimposed manner, and then are collectively transferred onto a transfer sheet S corresponding to a transferred medium that is a recording medium.

The superimposed transfer on the transfer belt 11 is performed at transfer positions where the transfer belt 11 faces the photosensitive elements 20BK, 20Y, 20M, and 20C, by applying a voltage through primary transfer rollers 12BK, 12Y, 12M, and 12C as transfer chargers disposed at positions facing the photosensitive elements 20BK, 20Y, 20M, and 20C with the transfer belt 11 interposed therebetween at timings shifted from an upstream side to a downstream side in the A1 direction so that the toner images formed on the photosensitive elements 20BK, 20Y, 20M, and 20C is transferred onto the same position of the transfer belt 11 in a superimposed manner while the transfer belt 11 moves in the A1 direction.

The image forming device 100 includes the main body 99 that occupies a central position in an up-down direction, a reading device 21 as a scanner that is positioned above the main body 99 and reads an original document, an automatic document feeder 22 called an ADF that is positioned above the reading device 21, stacks the original document thereon, and feeds the stacked original document to the reading device 21, and a sheet feed device 23 as a paper feed table that is positioned below the main body 99 and stacks the transfer sheet S to be transported toward between the photosensitive elements 20BK, 20Y, 20M, and 20C and the intermediate transfer belt 11 thereon.

The image forming device 100 further includes four image stations 60BK, 60Y, 60M, and 60C, a transfer belt unit 10 that is an intermediate transfer device as an intermediate transfer unit that is opposedly disposed below the photosensitive elements 20BK, 20Y, 20M, and 20C and includes the transfer belt 11, and a secondary transfer device 47 that is a secondary transfer unit as a transfer unit that is opposedly disposed below the transfer belt unit 10 and transfers the toner image on the transfer belt 11 onto the transfer sheet S.

The image forming device 100 further includes a cleaning device 32 that is an intermediate transfer belt cleaning unit as an intermediate transfer belt cleaning device that is disposed to face the transfer belt 11 between the secondary transfer device 47 and the image station 60BK in the direction A1 and cleans the surface of the transfer belt 11.

The image forming device 100 further includes an optical scanning device 8 corresponding to a latent image forming unit as an optical writing device that is a writing unit that is opposedly disposed above the image stations 60BK, 60Y, 60M, and 60C, a waste toner storing section 34 for the intermediate transfer body that is disposed to face the secondary transfer device 47 below the secondary transfer device 47, and a toner transport path (not shown) that connects the cleaning device 32 with the waste toner storing section 34 for the intermediate transfer body.

The image forming device 100 further includes a resist roller pair 13 that delivers the transfer sheet S transported from the sheet feed device 23 toward the secondary transfer section between the transfer belt 11 and the secondary transfer device 47 at a predetermined timing matched to the timings of forming the toner image by the image stations 60BK, 60Y, 60M, and 60C, and a sensor (not shown) that detects the front end of the transfer sheet S arrived at the resist roller pair 13.

The image forming device 100 further includes a fixing device 6 corresponding to a fixing section that is a fixing unit of a belt fixing system that, after a toner image is transferred, fixes the same toner image onto the transfer sheet S transported in the arrow C1 direction, a discharging roller 7 that discharges the transfer sheet S having passed through the fixing device 6 to the outside of the main body 99, and a side plate 89 that is openably or closably disposed at a position facing the fixing device 6.

The image forming device 100 further includes a paper discharge tray 17 as a paper discharge section that is disposed above the main body 99 and stacks the transfer sheet S discharged to the outside of the main body 99 by the discharging roller 7 thereon, and a toner bottle (not shown) in which toners of colors of yellow, magenta, cyan, and black are filled.

Figure 3:
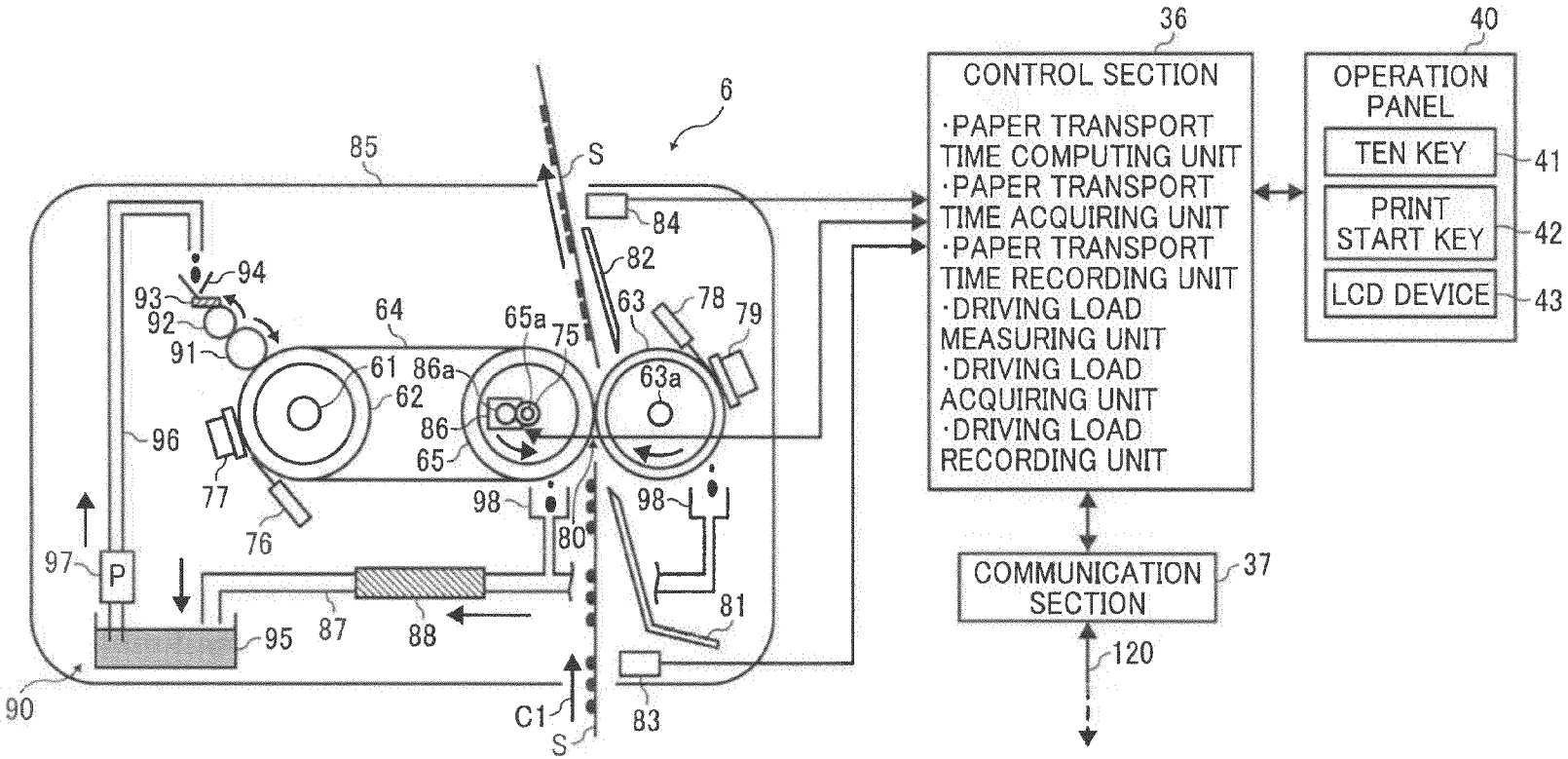
FIG. 3 is a control block diagram illustrating a configuration of a fixing section and a failure diagnosis device disposed in the image forming device illustrated in FIG. 2.

The image forming device 100 further includes a control section 36 as a control unit that controls an overall operation of the image forming device 100, a communication section 37 as a communication unit that is connected with a LAN 120, controlled by the control section 36, and performs communication with the failure diagnosis device 110, and an operation panel 40 through which an operator such as a user performs an operation of the image forming device 100 as illustrated in FIG. 3.

As illustrated in FIG. 2, the image forming device 100 is an image forming device of an in-body discharge type in which the paper discharge tray 17 is disposed above the main body 99 and below the reading device 21. The transfer sheet S stacked on the paper discharge tray 17 is taken out to a downstream side of the D1 direction corresponding to the left in FIG. 2.

The transfer belt unit 10 includes primary transfer rollers 12BK, 12Y, 12M, and 12C, a tension roller 72 around which the intermediate transfer belt 11 is wound, a cleaning counter roller 73 that is disposed to face the cleaning device 32 with the intermediate transfer belt 11 interposed therebetween and also functions as the driving roller, a transfer entrance roller 74 as a secondary transfer counter roller that is not only a driven roller facing the secondary transfer device 47 with the intermediate transfer belt 11 interposed therebetween but also a stretching roller, a spring 28 that urges the tension roller 72 in a direction away from the cleaning counter roller 73, and a pair of intermediate transfer section side plates (not shown) that are disposed to rotatably support both sides of each of the rollers over which the transfer belt 11 is stretched, that is, the tension roller 72, the cleaning counter roller 73, and the transfer entrance roller 74 and interpose the intermediate transfer belt 11 therebetween.

The secondary transfer device 47 includes a secondary transfer roller 5 that is a secondary transfer counter roller as a transfer member that rotates in the same direction as the transfer belt 11 at a position abutting on the transfer belt 11 and a high voltage source (not shown) that is connected with the secondary transfer roller 5 and applies a secondary transfer bias to the transfer belt 11 to transfer the toner image on the transfer belt 11 onto the transfer sheet S. A bias value applied by the high voltage source is controlled by the control section 36.

The secondary transfer roller 5 faces the transfer entrance roller 74 with the transfer belt 11 interposed therebetween and forms a secondary transfer section between itself and the intermediate transfer belt 11. The secondary transfer roller 5 is constituted by coating an elastic body made of urethane whose resistance is adjusted by a conductive material on a cored bar made of metal such as steel use stainless (SUS).

The cleaning device 32 includes an intermediate transfer cleaning blade 35 as a cleaning blade that abuts on the transfer belt 11 at a position facing the cleaning counter roller 73. The cleaning device 32 cleans the transfer belt 11 by scraping undesired substances such as toners or paper powder which remain on the transfer belt 11 after transfer, through the intermediate transfer cleaning blade 35.

The intermediate transfer cleaning blade 35 abuts on the transfer belt 11 in a counter direction. Undesired substances such as toners, which remain after transfer, scraped by the intermediate transfer cleaning blade 35 are passed through the toner transport path and stored in the waste toner storing section 34 for the intermediate transfer body. At least one of a portion of the transfer belt 11 corresponding to a cleaning nip portion that abuts on the intermediate transfer cleaning blade 35 and an edge portion of the intermediate transfer cleaning blade 35 is coated with a liniment such as a lubricant agent, a toner, and a zinc stearate when mounted. Therefore, the intermediate transfer cleaning blade 35 is prevented from being rolled up in the cleaning nip portion and forms a dam layer in the cleaning nip portion so that a cleaning performance is improved.

The optical scanning device 8 is a laser beam scanner that uses a laser diode as a light source. The optical scanning device 8 scans and exposes scanned surfaces composed of surfaces of the photosensitive elements 20BK, 20Y, 20M, and 20C and emits beams LBK, LY, LM, and LC that are laser light as laser beam based on an image signal to form an electrostatic latent image. The optical scanning device 8 may use a light emitting diode (LED) as a light source.

The optical scanning device 8 is detachably attached to the main body 99 and is configured so that process cartridges, which will be described later, respectively disposed in the image stations 60BK, 60Y, 60M, and 60C can be independently taken out of the main body 99 when the optical scanning device 8 is detached.

The sheet feed device 23 includes a paper feed tray 15 on which the transfer sheet S is stacked and a paper feeding roller 16 as a paper feed transport roller that feeds the transfer sheet S stacked on the paper feed tray 15. The paper feed tray 15 is configured to be able to stack transfer sheets S of multiple sizes.

The reading device 21 is positioned above the main body 99 and is combined with the main body 99 to be turnable by a shaft 24 disposed at an end portion of the image forming device 100 at the upstream side of the D1 direction, in other words, at a back side of the image forming device 100 to be openable or closable relative to the main body 99.

The reading device 21 includes, at a D1 direction downstream side end thereof, a grip section 25 that is gripped to open the reading device 21 from the main body 99. The reading device 21 is turnable on the shaft 24 and so is opened from the main body 99 by gripping and upward turning the grip section 25. An opening angle of the reading device 21 to the main body 99 is about 90°, and thus it is easy to perform an operation of accessing the inside of the main body 99 and closing the reading device 21.

The reading device 21 includes a contact glass 21*a* on which the original document is placed, a first traveling body 21*b* that includes a light source (not shown) for irradiating light to the original document placed on the contact glass 21*a* and a first reflector (not shown) for reflecting light that is irradiated from the light source and reflected by the original document and travels in a left-right direction in FIG. 2, a second traveling body 21*c* that includes a second reflector (not shown) for reflecting light reflected by the reflector of the first traveling body 21*b*, an imaging lens 21*d* that focuses light from the second traveling body 21*c*, and a reading sensor 21*e* that receives light having passed through the imaging lens 21*d* and reads a content of the original document.

The automatic document feeder 22 is positioned above the reading device 21 and is combined with the reading device 21 to be turnable by a shaft 26 disposed at an end portion of the image forming device 100 at the D1 direction upstream side to be openable or closable relative to the reading device 21.

The automatic document feeder 22 includes a grip section 27 that is gripped to open the automatic document feeder 22 from the reading device 21 at the D1 direction downstream side end. The automatic document feeder 22 is turnable on the shaft 26 and so is opened from the reading device 21 by gripping and upward turning the grip section 27, exposing the contact glass 21*a*.

The automatic document feeder 22 includes a platen 22*a* on which the original document is placed and a driving section including a motor (not shown) that feeds the original document placed on the platen 22*a*. In order to perform copying through the image forming device 100, the original document is set on the platen 22*a* of the automatic document feeder 22, or the automatic document feeder 22 is turned upward, the original document is manually placed on the contact glass 21*a*, and then the automatic document feeder 22 is closed to press the original document against the contact glass 21*a*. An opening angle of the automatic document feeder 22 to the reading device 21 is about 90°, and thus it is easy to place the original document on the contact glass 21*a* and perform a maintenance work on the contact glass 21*a*.

As illustrated in FIG. 3, the fixing device 6 includes a heating roller heater 61 as a heat source, a heating roller 62 of a roller shape inside which the heating roller heater 61 is disposed, a fixing belt 64 as a fixing member that is wound around the heating roller 62, a fixing roller 65 of a roller shape that is rotatable on a shaft 65*a* and around which, and around the heating roller 62, the fixing belt 64 is wound, and a pressing roller 63 as a pressing member of a roller shape that is disposed at a position facing the fixing roller 65 with the fixing belt 64 interposed therebetween and comes in press contact with the fixing belt 64 between itself and the fixing roller 65 to form a fixing nip 80 that is a press contact section.

The fixing device 6 includes a first thermistor 76 and a first thermostat 77 that detect a temperature of a portion of the fixing belt 64 wound around the heating roller 62, and a second thermistor 78 and a second thermostat 79 that detect a temperature of the pressing roller 63 near an upstream side of the fixing nip 80 in the rotation direction of the pressing roller 63.

The fixing device 6 further includes an entrance guide plate 81 that is disposed at an upstream side of the fixing nip 80 in a C1 direction and guides the transfer sheet S to the fixing nip 80 and an exit guide plate 82 that is disposed at a downstream side of the fixing nip 80 in the C1 direction and guides and discharges the transfer sheet S having passed through the fixing nip 80 to the outside of the fixing device 6.

The fixing device 6 further includes a fixing entrance sensor 83 that detects the front end of the transfer sheet S that enters the inside of the fixing device 6 and is guided by the entrance guide plate 81 and a fixing exit sensor 84 that detects the front end of the transfer sheet S that has been passed through the fixing nip 80 and is guided by the exit guide plate 82 to be discharged to the outside of the fixing device 6.

The fixing device 6 further includes a driving gear 75, which is a fixing driving gear as an image forming device main body side member disposed at the main body 99 side, and that is disposed integrally with the shaft 65*a* and rotatively drives the fixing roller 65, the fixing belt 64, the heating roller 62, and the pressing roller 63, and a motor 86 that is a driving source as a fixing driving source that includes an output gear 86*a* meshed with the driving gear 75 and rotatively drives the fixing roller 65, the fixing belt 64, the heating roller 62, and the pressing roller 63 and that is also a fixing driving motor as an image forming device main body side member disposed at the main body 99 side.

The fixing device 6 further includes a releasing agent supply unit 90 that is a releasing agent coating unit that coats and supplies the fixing belt 64 with a releasing agent for improving releasability between the fixing belt 64 and the transfer sheet S, and a fixing case 85 that supports components excluding the driving gear 75 and the motor 86 among the above-described components disposed in the fixing device 6 in a surrounding manner.

The components excluding the driving gear 75 and the motor 86 among the above-described components disposed in the fixing device 6 form a fixing unit that is detachably attached to the main body 99. When the side plate 89 is opened, the fixing device 6 is exposed to the outside of the main body 99, so that the fixing unit can be taken out of the main body 99. Such unitization makes it possible to handle the fixing device 6 as a replacement component, and thus it is easy to access it, for the purpose of repair, etc., in a state taken out of the main body 99. Therefore, since maintenancebility is significantly improved, it is very desirable. When the fixing unit is taken out of the main body 99, the driving gear 75 and the motor 86 among the above-described components disposed in the fixing device 6 are left on the main body 99 side, and the driving gear 75 is exposed toward the outside of the main body 99. This makes it easy to access the driving gear 75 and the motor 86 from the outside of the main body 99, and thus repair, replacement or the like can be easily performed.

Both the fixing entrance sensor 83 and the fixing exit sensor 84 are configured with a reflective type photointerrupter and detect the front end of the transfer sheet S by detecting the reflected light when the transfer sheet S is passing through. Both the fixing entrance sensor 83 and the fixing exit sensor 84 input signals representing that they are detecting the transfer sheet S to the control section 36.

The first thermistor 76, the first thermostat 77, the second thermistor 78, and the second thermostat 79 are used to enable the fixing nip 80 to keep a temperature suitable for fixing. The temperatures detected by them are appropriately used in driving control of the heating roller heater 61.

The heating roller 62 is heated by the heating roller heater 61, and the fixing belt 64 is heated by heat of the heating roller 62. The fixing belt 64 and the pressing roller 63 are rotatively driven by the fixing roller 65 that is rotatively driven by the motor 86.

The pressing roller 63 has a shaft 63*a* which becomes a rotation center thereof. The shaft 63*a* is movably supported to the fixing case 85 so that a circumferential surface of the pressing roller 63 can contact with or be separated from the fixing belt 64. The pressing roller 63 comes in press contact with the fixing belt 64 and the fixing roller 65 to form the fixing nip 80.

In order to improve an image quality, a surface of the fixing belt 64 at the pressing roller 63 side, that is, at a side that comes in contact with a surface or an image surface of the transfer sheet S, has a mirror surface, which enables the fixing belt 64 to easily come in close contact with the transfer sheet S. The fixing belt 64 has the mirror surface and thus easily comes in close contact with the transfer sheet S, but it tends to decrease separation of the transfer sheet S.

The releasing agent supply unit 90 coats and supplies the fixing belt with the releasing agent for improving releasability between the fixing belt 64 and the transfer sheet S in order to improve separation between the surface of the fixing belt 64 and the transfer sheet S. The releasing agent is not limited to but may include a liquid releasing agent such as silicon oil or a powder releasing agent such as paraffin. In the present embodiment, silicon oil that is high in thermal resistance and is widely used as a releasing agent for fixing is used as the releasing agent. Hereinafter, the releasing agent is referred to simply as "oil".

The releasing agent supply unit 90 includes an oil coating roller 91 that is a first releasing agent coating member corresponding to a first releasing agent coating roller that abuts on the fixing belt 64 at a position facing the heating roller 62 and rotates together with the fixing belt 64 to coat and supply the fixing belt 64 with oil, and an oil supply roller 92 that is a second releasing agent supply member corresponding to a second releasing agent supply roller that abuts on the oil coating roller 91 at a position of a side opposite to the heating roller 62 and rotates together with the oil coating roller 91 to supply the oil coating roller 91 with oil.

The releasing agent supply unit 90 further includes a coating felt 93 that is an oil coating felt as a supply member corresponding to a releasing agent supply member as a releasing agent coating member that abuts on the oil supply roller 92 at a position opposite to the oil coating roller 91 and comes in slide contact with the oil supply roller 92 to spread and supply oil to the oil supply roller 92 and is detachably attached to the releasing agent supply unit 90 main body, and an oil pan 94 that is disposed above the coating felt 93 and supplies the coating felt 93 with oil by dropping oil.

The releasing agent supply unit 90 further includes a tank 95 corresponding to an oil tank that is an oil reservoir as a releasing agent reservoir in which oil is stored, an oil tube 96 that is a first oil tube as a first releasing agent supply tube that allows oil to pass through the inside thereof and supplies the oil pan 94 with oil stored in the tank 95, a pump 97 that pumps oil toward the oil pan 94 by sucking oil stored in the tank into the oil tube 96 and passing oil through the oil tube 96, and a driving power source (not shown) as a releasing agent supply driving source that applies a driving voltage to the pump 97.

The releasing agent supply unit 90 further includes an oil plate 98 as a releasing agent receiver that receives and collects a surplus of oil supplied to the fixing belt 64 or a surplus of oil supplied to be transferred from the fixing belt 64 to the pressing roller 63, an oil tube 87 (partially not shown) that is a second oil tube as a second releasing agent supply tube that passes oil collected in the oil plate 98 through the inside thereof to be returned to the tank 95, and an oil filter 88 corresponding to a releasing agent filter that is a releasing agent filtration member that is detachably attached to a middle portion of the oil tube 87, filters and removes impurities such as paper powder or toners contained in oil passing through the inside of the oil tube 87 to clean oil, and returns clean oil to the tank 95.

In the releasing agent supply unit 90 having such a configuration, when the pump 97 is driven by the driving power source, the driven pump 97 supplies oil in the tank 95 to the oil pan 94 via the oil tube 96, and oil supplied to the oil pan 94 is coated on the fixing belt 64 through the coating felt 93, the oil supply roller 92, and the oil coating roller 91. Part of oil coated on the fixing belt 64 is attached to the transfer sheet S and expended when the transfer sheet S passes through the fixing nip 80, but a surplus is collected in the oil plate 98 directly from the fixing belt 64 or from the pressing roller 63 after attached to the pressing roller 63 abutting on the fixing belt 64, passes through the oil tube 87, then cleaned by the oil filter 88 in the middle, and returned to the tank 95. In this way, the releasing agent supply unit 90 repetitively circulates oil to be reused and thus is excellent in economic and environmental efficiencies. The tank 95 stores oil of a sufficient amount anticipated considering both that oil is circulated and used and that oil is expended.

The transfer sheet S on which the toner image is supported passes through the fixing device 6 with being tucked in the fixing nip 80 so that the surface of the transfer sheet S can contact the fixing belt 64. As a result, the supported toner image is fixed onto the surface of the transfer sheet S by influence of heat of the fixing belt 64 heated by the heating roller heater 61 via the heating roller 62 and pressure between the fixing belt 64 and the pressing roller 63.

The fixing device 6 changes a process speed, that is, a rotation speed of the heating roller 62, the pressing roller 63, the fixing belt 64, and the fixing roller 65 at the time of fixing by changing the driving speed of the motor 86 according to a kind of the transfer sheet S. Specially, according to the paper thickness, the ticker the paper thickness is, the slower the process speed is. The thicker the thickness of the transfer sheet S is, the slower the transfer sheet S passes through the fixing nip 80, thereby securing fixability of the toner image. Driving control of the motor 86 including changing the driving speed of the motor 86 is performed by the control section 36.

The other functions of the fixing device 6 will be described later.

Even though not shown, the control section 36 includes a central processing section (CPU) and, as a memory, a read only memory (ROM) as a first memory unit that stores an operation program of the image forming device 100 and a variety of data necessary for an operation of the operation program and a random access memory (RAM) as a second memory unit that stores data necessary for an operation of the image forming device 100.

The control section 36 computes and acquires a time, which is taken from a point in time when the front end of the transfer sheet S starts to be detected by the fixing entrance sensor 83 to a point in time when the front end of the transfer sheet S starts to be detected by the fixing exit sensor 84, based on a difference between a signal reception start time from the fixing entrance sensor 83 and a signal reception start time from the fixing exit sensor 84 through the CPU as a paper transport time in the fixing device 6 and stores the paper transport time in the RAM. In this regard, the control section 36 functions as a paper transport time computing unit, a paper transport time acquiring unit, and a paper transport time recording unit as a first paper transport time recording unit.

Further, the paper transport time computing unit or the paper transport time acquiring unit may include the fixing entrance sensor 83 or the fixing exit sensor 84 in addition to the control section 36.

In a state in which an integration value of a number of sheets on which an image is formed is equal to or more than a set value, at a time immediately after an operation voltage of the image forming device 100 is applied or when an image forming operation is finished, the control section 36 drives a communication section 37 and requests the failure diagnosis device 110 to perform communication for transmitting the paper transport time stored in the control section 36 as the paper transport time recording unit while identifying the corresponding image forming device 100 to the failure diagnosis device 110.

The other operations and functions of the control section 36 will be described later.

The operation panel 40 includes a ten key 41 for designating an image forming number, a print start key 42 for instructing a start of image forming, and a liquid crystal display (LCD) device 43 as a display unit for displaying a state of the image forming device 100 to a user.

In connection with the image stations 60BK, 60Y, 60M, and 60C, a configuration of the image station 60BK having the photosensitive element 20BK will be representatively described with reference to FIG. 2. Since the configurations of the other image stations are substantially the same, for convenience, it is assumed in the following explanation that symbols corresponding to symbols attached to the configuration of the image station 60BK are attached to the configurations of the other image stations, and detailed description thereof will be appropriately omitted. BK, Y, M, C added behind the symbols represent configurations for forming images of black, yellow, magenta, and cyan, respectively.

The image station 60BK having the photosensitive element 20BK includes a primary transfer roller 12BK, a cleaning device 70BK as a cleaning unit for cleaning the photosensitive element 20BK, a charging device 30BK corresponding to a charging charger as a charging device that is a charging unit for charging the photosensitive element 20BK to a high voltage, and a developing device 50BK that is a developer as a developing unit for developing the photosensitive element 20BK, which are disposed around the photosensitive element 20BK along a rotation direction B1 that is a clockwise direction in FIG. 2.

The photosensitive element 20BK, the cleaning device 70BK, the charging device 30BK, and the developing device 50BK are integrated to constitute the process cartridge. The process cartridge is detachably attached to the main body 99. Constituting the components as one process cartridge is very desirable because the components can be handled as a single unitized replacement component, thereby significantly improving maintenancebility.

The photosensitive element 20BK is rotatively driven at a peripheral speed of 120 mm/s.

The charging device 30BK includes a brush roller (details are not shown) and a high voltage source (not shown) that applies a bias to the brush roller. The brush roller comes in press contact with the surface of the photosensitive element 20BK and is drivenly rotated by the photosensitive element 20BK. The high voltage source applies a bias in which an alternating current (AC) is superimposed to a direct current (DC) but it may alternatively apply a DC bias. The surface of the photosensitive element 20BK is uniformly charged to −500 V by the charging device 30BK.

The developing device 50BK includes a developing roller 51BK disposed at a position facing the photosensitive element 20BK, a developing roller driving motor (not shown) as a driving source that rotatively drives the developing roller 51BK, and a high voltage source (not shown) that applies a developing bias to the developing roller 51BK.

The developing roller 51BK has a diameter of ϕ12 mm and is rotatively driven at a linear speed of 160 mm/s by the driving roller driving motor. Driving of the developing roller driving motor is controlled by the control section 36. The developing device 50BK performs one component contact development and uses, as a developer, a toner having a minus polarity as a normal charging characteristic. The developing device 50BK stores the toner of 180 g in a new state, in other words, initially.

In the image forming device having the above-described configuration, when performing full-color image forming and the print start key 42 in the operation panel 40 is held down, the photosensitive element 20BK rotates in the B1 direction. With this rotation, the surface of the photosensitive element 20BK is uniformly charged by the charging device 30BK and a beam LBK is exposure-scanned by the optical scanning device 8 so that an electrostatic latent image is formed based on image information corresponding to black. The electrostatic latent image is formed by scanning the beam LBK in a main scanning direction that is a vertical direction to the paper plane and performing scanning in a sub scanning direction that is a circumferential direction of the photosensitive element 20BK by the rotation of the photosensitive element 20BK in the B1 direction.

The charged black toner supplied from the developing device 50BK is attached to the electrostatic latent image formed in this way, developed into black, and visualized. The toner image as a black visible image obtained by development is primarily transferred to the transfer belt 11 moving in the A1 direction by the primary transfer roller 12BK. Foreign substances such as the toner remaining after transfer are scraped and removed by the cleaning device 70BK and stockpiled. The photosensitive element 20BK is then served for next charging by the charging device 30BK.

Similarly even in the other photosensitive elements 20Y, 20M, and 20C, the toner images of respective colors are formed, and the toner images of respective colors formed are sequentially primarily transferred at the same position on the transfer belt 11 moving in the A1 direction by the primary transfer rollers 12Y, 12M, and 12C.

As the transfer belt 11 rotates in the A1 direction, the toner images superimposed on the transfer belt 11 move to a transfer section as a secondary transfer section that is a position facing the secondary transfer roller 5. A secondary transfer bias of predetermined amplitude is applied by the high voltage source of the secondary transfer device 47 under control of the control section 36, and so the secondary transfer is performed such that the toner images are transferred onto the transfer sheet S in the transfer section.

The transfer sheet S transported to between the transfer belt 11 and the secondary transfer roller 5 is one which was delivered from the sheet feed device 23 and then sent out by the resist roller pair 13 so as to match timing when the front end of the toner image on the transfer belt 11 faces the secondary transfer roller 5 based on a detection signal from a sensor.

The toner images of all colors are collective transferred and supported to the transfer sheet S and the transfer sheet S is separated from the transfer belt 11 due to the curvature of the transfer entrance roller 74, transported in the C1 direction and enters the fixing device 6. When the transfer sheet S passes through the fixing nip 80, the supported toner images are fixed to the transfer sheet S due to influence of heat and pressure, and a full-color color image as a synthetic color image is formed on the transfer sheet S by this fixing process.

The transfer sheet S which passed through the fixing device 6 and completed fixing is stacked on the paper discharge tray 17 through the discharging roller 7. The transfer belt 11 that finished the secondary transfer is cleaned by the cleaning device 32 each time and gets ready for next primary transfer.

In the image forming device 100 described, a failure of the fixing device 6 is diagnosed through the failure diagnosis device 110 as will be described later.

A failure of the fixing device 6 diagnosed by the failure diagnosis device 110 relates to poor oil feeding of the fixing belt 64, that is, a failure or functional deterioration of the releasing agent supply unit 90.

A failure or functional deterioration of the releasing agent supply unit 90 will be described.

As described above, the releasing agent supply unit 90 repetitively circulates oil to be reused in view of economic and environmental efficiencies.

Schematically, if the image forming operation is performed and the paper is passed through the fixing device 6 in the image forming device 100 as described above, a failure or function deterioration in the releasing agent supply unit 90 with the above-described configuration occurs in the following order:

1. the oil filter 88 is gradually polluted by filtration of the impurities, so that the filtration function deteriorates,
2. as the filtration function of the oil filter 88 deteriorates, polluted oil is supplied to the coating felt 93,
3. the coating felt 93 is clogged, so that an oil supply amount to the fixing belt 64 decreases, and
4. as the oil supply amount to the fixing belt 64 decreases, a separation jam caused by poor separation of the transfer sheet S from the fixing belt 64 or the pressing roller 63, locking in meshing between the output gear 86*a* and the driving gear 75, and locking of the motor 86 occur.

The failure or the functional deterioration will be described below in more detail.

In the above-described image forming operation in the image forming device 100, at the initial stage, clean oil is supplied to the coating felt 93, the degree of contamination of the oil filter 88 is low even when oil is circulated, and thus good filtration function, in other words, good filtration ability is obtained. However, if the image forming number, in other words, a number of printed sheets increases, the oil filter 88 is polluted due to filtration of the impurities, and so the filtration function gradually deteriorates. For this reason, oil supplied, in other words, input to the coating felt 93 is also gradually polluted by the impurities, the function of the coating felt 93 deteriorates due to clogging or the like, and the oil supply amount to the fixing belt 64 decreases. In this situation, oil is not sufficiently supplied to the transfer sheet S passing through the fixing nip 80, and the oil supply function deteriorates. In the worst case, a separation jam that is poor separation of the transfer sheet S from the fixing belt 64 or the pressing roller 63, that is, a so-called fixing jam happens. If such oil supply function deterioration happens, frictional resistance force between the oil coating roller 91 and the fixing belt 64 increases. The frictional resistance force acts as brake force against rotation of the fixing belt 64, and thus a load of the motor 86 increases. In the worst case, locking in meshing between the output gear 86*a* and the driving gear 75, and locking of the motor 86 happen.

As a technique of dealing with the failure or the functional deterioration of the releasing agent supply unit 90, a technique of estimating the degree of contamination of oil and replacing the oil filter 88 or the coating felt 93 at appropriate timing may be considered.

However, the degree of contamination of oil depends on a use environment of the image forming device 100, the fixing device 6, and the releasing agent supply unit 90 such as a kind of the transfer sheet S used for image forming, for example, a kind of the transfer sheet S, depending on which is large or small in paper powder amount is determined, a toner condition used for image forming, for example, a toner amount depending on whether an image forming area ratio is large or smaller. Therefore, it is difficult to exactly estimate the degree of contamination of oil. For example, if the degree of contamination of oil is estimated and replacement timing of the oil filter 88 is determined by assuming that a kind of the transfer sheet S and the toner amount that cause the worst oil contamination are used, when the transfer sheet S of a paper kind that generates a small amount of paper powder is used, replacement timing of the oil filter 88 is too early, and the oil filter 88 that can be still used is replaced, leading to waste. If the degree of contamination of oil is estimated and replacement timing of the oil filter 88 is determined by assuming a standard oil contamination condition, that is, a standard use of the image forming device 100, when the transfer sheet S of a paper kind that generates a large amount of paper powder is used, replacement timing of the oil filter 88 is too late, and the oil filter 88 is replaced after the separation jam happens, leading to downtime.

For this reason, the failure diagnosis device 110 performs failure diagnosis of the fixing device 6 including estimation of a cause of trouble of the fixing device 6, that is, a failure or functional deterioration of the releasing agent supply unit 90, specially, functional deterioration or degradation of the oil filter 88 and the coating felt 93. Functional deterioration of the oil filter 88 is equivalent to an increment in the degree of contamination of oil, and function deterioration of the coating felt 93 is equivalent to a decrement in an oil attachment amount of the fixing belt 64. If function deterioration of the oil filter 88 and the coating felt 93 can be estimated, appropriate replacement timings of the oil filter 88 and the coating felt 93 can be also estimated.

Figure 4:
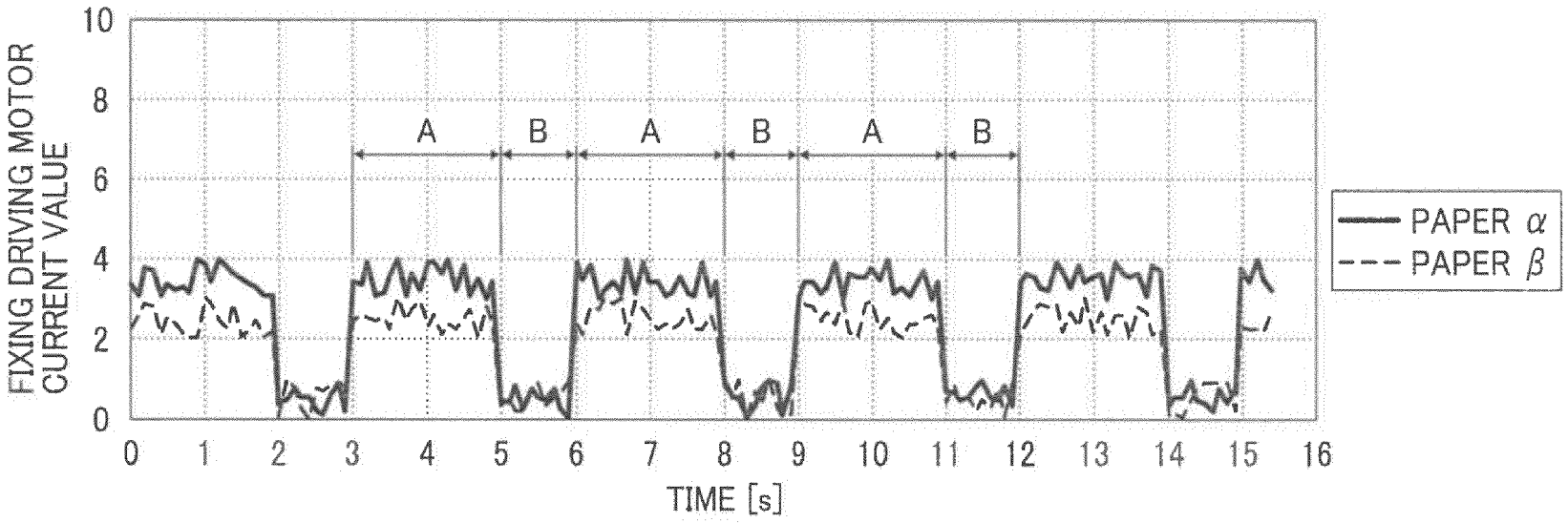
FIG. 4 is a correlation diagram illustrating a correlation between a current value of a fixing driving motor as a driving load of a fixing section and a timing at which a paper passes the fixing section.

FIG. 4 illustrates a current wave of a driving current of the motor 86 when a paper $\alpha$ and a paper $\beta$, that is, two kinds of transfer sheets S pass through the fixing nip 80 at the time of image forming and a current wave of a driving current of the motor 86 when the transfer sheet S does not pass through the fixing nip 80. In FIG. 4, a time period indicated by A represents when the transfer sheet S passes through the fixing nip 80, and a time period indicated by B represents when the transfer sheet S does not pass through the fixing nip 80. The paper $\alpha$ and the paper $\beta$ are different in thickness, and the paper $\alpha$ is thicker than the paper $\beta$.

It can be understood from FIG. 4 that in both the paper $\alpha$ and the paper $\beta$, a current value of the driving current of the motor 86 increases when the transfer sheet S passes through the fixing nip 80. This is because a load of the motor 86 for transporting the transfer sheet S, that is, a driving load of the fixing device 6 increases when the transfer sheet S passes through the fixing nip 80.

The failure diagnosis device 110 performs failure diagnosis of the fixing device 6 including estimation of a cause of trouble of the fixing device 6, that is, a failure or function deterioration of the releasing agent supply unit 90, specially, function deterioration or degradation of the oil filter 88 and the coating felt 93 as a plurality of causes of trouble of the fixing device 6 by using the driving load of the fixing device 6, specially, the current value of the driving current of the motor 86.

To this end, the control section 36, for example, measures the current value of the driving current of the motor 86 in performing driving control of the motor 86.

Specifically, the control section 36 measures and acquires the current value of the driving current of the motor 86 during a time from the signal reception start time of the fixing entrance sensor 83 to the signal reception start time of the fixing exit sensor 84 as the driving load of the fixing device 6 and stores the current value in the RAM. In this regard, the control section 36 functions as a driving load measuring unit, a driving load acquiring unit, and a driving load recording unit as a first driving load recording unit. The driving load measuring unit or the driving load acquiring unit may include the fixing entrance sensor 83 or the fixing exit sensor 84 in addition to the control section 36.

Further, in the present embodiment, the driving current of the motor 86 is used as the driving load of the fixing device 6, but if it is possible to measure any other value representing the driving load of the fixing device 6, the value may be used in failure diagnosis of the fixing device 6 including the estimation.

As described above, the control section 36 drives the communication section 37 and requests the failure diagnosis device 110 to establish communication for transmitting the paper transport time stored in the control section 36 as the paper transport time recording unit while identifying the corresponding image forming device 100 to the failure diagnosis device 110. At this time, the control section 36 requests the failure diagnosis device 110 to establish communication for transmitting, together with the paper transport time, the driving load stored in the control section 36 as the driving load recording unit while identifying a corresponding image forming device 100 to the failure diagnosis device 110.

The failure diagnosis device 110 has the following configuration for diagnosing a failure of the fixing device 6. The failure diagnosis device 110 collects a plurality of paper transport times and a plurality of driving loads, which are acquired by the control section 36 as the paper transport time acquiring unit and the driving load acquiring unit and recorded by the control section 36 as the transport time recording unit and the driving load recording unit, through the communication section 37, the LAN 120, and the Internet 130. To this end, the failure diagnosis device 110 includes a data collector 111 connected to the Internet 130, a state database 112 that is a paper transport time recording unit as a second paper transport time recording unit and a driving load recording unit as a second driving load recording unit that store and accumulate the plurality of the paper transport times and the plurality of the driving loads collected by the data collector 111 in a manner in which they are assigned to the corresponding image forming devices 100, an inference engine 113 as a diagnosis unit that diagnoses a failure of the fixing devices 6 of the corresponding image forming devices 100 using the plurality of the paper transport times and the plurality of the driving loads of each image forming devices 100 accumulated in the state database 112, and a system controller 114 that is connected with the PC 140 through the LAN 150 and controls the data collector 111, the state database 112, and the inference engine 113.

The data collector 111 has a predetermined communication function that performs communication for collecting the plurality of the paper transport times and the plurality of the driving loads for each image forming devices 100. The data collector 111 receives a communication request from the communication section 37 for transmitting the plurality of the paper transport times and the plurality of the driving loads stored in the control section 36 as the paper transport time recording unit and the driving load recording unit to the failure diagnosis device 110. When the request is received, the data collector 111 instructs the corresponding image forming device 100 to transmit the plurality of the paper transport times and the plurality of the driving loads and collectively receives the plurality of the paper transport times and the plurality of the driving loads from the corresponding image forming device 100.

The state database 112 has a memory function for storing the plurality of the paper transport times and the plurality of the driving loads and is formed by a semiconductor medium (for example, ROM or non-volatile memory), an optical medium (for example, DVD, MO, MD, or CD-R), a magnetic medium (for example, hard disk, magnetic tape, or flexible disk), etc. The state database 112 records, in an additive manner as a new file, the plurality of the paper transport times and the plurality of the driving loads received by the data collector 111 in a manner in which they are assigned to the corresponding image forming device 100.

The inference engine 113 includes a CPU or the like that performs computation for performing the diagnosis. The inference engine 113 also has a function for notifying that failure occurs in the fixing device 6 while identifying the image forming device 100 in which that failure occurs, for example, by transmitting an electronic mail to a service engineer or a user when the fixing device 6 is diagnosed as having a failure. This point will be described later.

The inference engine 113 computes and acquires a plurality of driving loads per time, that is, in unit time length, i.e., a plurality of unit time driving loads by dividing, by each of the plurality of the paper transport times, the corresponding driving load, they being accumulated in the state database 112. In this regard, the inference engine 113 functions as the driving load computing unit that is a unit time driving load computing unit and the driving load acquiring unit that is a unit time driving load acquiring unit. The plurality of the driving loads that is the plurality of the unit time driving loads is stored and accumulated in the state database 112 in a manner in which they are assigned to the corresponding image forming devices 100. In this regard, the state database 112 functions as the driving load recording unit that is a unit time driving load recording unit.

Further, in the present embodiment, the paper feed tray 15 is configured to be able to stack the transfer sheets S of multiple sizes, and the paper transport time is different depending on the size of the transfer sheet S. Therefore, the inference engine 113 is configured to function as the unit time driving load computing unit, the driving load computing unit, the unit time driving load acquiring unit, and the driving load acquiring unit. However, when the paper feed tray 15 is configured to stack the transfer sheet S of a single size, the driving load measured and acquired by the control section 36 that functions as the driving load measuring unit and the driving load acquiring unit can be used "as is" instead of the unit time driving load, and it is unnecessary to compute, acquire, record, transmit, and receive the paper transport time. Further, even when the paper feed tray 115 is configured to be able to stack the transfer sheets S of multiple sizes, if the image forming device 100 has a size detecting unit that detects the size of the transfer sheet S in the paper feed tray 115, the unit time driving load and the driving load may be computed and recorded by dividing the driving load by the size of the transfer sheet S detected by the size detecting unit. In this case, instead of the paper transport time, the size of the transfer sheet S is detected, acquired, recorded, transmitted, and received.

In order to perform such control and store data necessary for control, the system controller 114 includes a CPU and, as a memory, a ROM as a first memory unit that stores an operation program of the failure diagnosis device 110 and a variety of data necessary for an operation of the operation program and a RAM as a second memory unit that stores data necessary for an operation of the failure diagnosis device 110.

The failure diagnosis device 110 performs a failure diagnosis method for diagnosing a failure of the fixing device 6 in the image forming device 100 using a state discrimination method which will be described next.

[Description of the State Discrimination Method]

A failure state is considered to be recognized by a peculiar unsteady movement in various forms in variation of data with time that was steady in a normal state.

The failure diagnosis device 110 uses, as target data for failure state determination, first to third feature quantities computed by the following method by the inference engine 113.

The first feature quantity represents an average of the plurality of the unit time driving loads, in a corresponding image forming device 100, which are acquired by the inference engine 113 as the driving load acquiring unit and recorded by the state database 112 as the driving load recording unit. The first feature quantity is computed by the inference engine 113 as an average value of the plurality of the unit time driving loads. In this regard, the inference engine 113 functions as a first feature quantity computing unit that computes the first feature quantity, that is, an average value computing unit.

The second feature quantity represents a deviation of the plurality of the unit time driving loads, in a corresponding image forming device 100, which are acquired by the inference engine 113 as the driving load acquiring unit and recorded by the state database 112 as the driving load recording unit. The second feature quantity is computed by the inference engine 113 as a standard deviation of the plurality of the unit time driving loads. In this regard, the inference engine 113 functions as a second feature quantity computing unit that computes the second feature quantity, that is, a standard deviation computing unit. The second feature quantity may be a variance of the plurality of the unit time driving loads. In this case, the inference engine 113 functions as a variance computing unit.

The third feature quantity represents a maximum value of the plurality of the unit time driving loads, in a corresponding image forming device 100, which are acquired by the inference engine 113 as the driving load acquiring unit and recorded by the state database 112 as the driving load recording unit. The third feature quantity is computed, specially, selected by the inference engine 113 as a maximum value of the plurality of the unit time driving loads. In this regard, the inference engine 113 functions as a third feature quantity computing unit that computes the third feature quantity, that is, a maximum value computing unit.

When the first to third feature quantities are computed from the same plurality of the unit time driving loads, a set of three values composed of the first to third feature quantities configures a condition data C in the corresponding image forming device 100. A plurality of condition data C is computed from the different pluralities of the unit time driving loads mutually and progressively shifted on time series as will be described later, and thus condition data sets C1 to Cn in the corresponding image forming device 100 are configured. The condition data sets C1 to Cn represent a temporal change in the condition data C in the corresponding image forming device 100, in other words, a temporal change in the first to third feature quantities in the corresponding image forming device 100.

The inference engine 113 as a diagnosis unit diagnoses a failure of the fixing device 6 disposed in the corresponding image forming device 100 for each image forming device 100 using the condition data sets C1 to Cn as follows.

The condition data sets C1 to Cn are created as will be described later and transmitted to a discriminator configured with the inference engine 113. The inference engine 113 as the discriminator computes a preliminary diagnosis result as to whether or not the fixing device 6 has a failure.

Specially, the inference engine 113 as the discriminator discriminates whether each feature quantity configuring each condition data C is normal or abnormal based on the following Expression (1) and provides a value Outi. The value Outi (here, 1 or −1) given when it is normal is different from the value Quti given when it is abnormal. In Expression (1), bi and sgni are determination conditions decided by using a boosting method which will be described later. The bi is a threshold of each feature quantity configuring each condition data Ci, and the sgni is a discrimination sign of each feature quantity configuring each condition data Ci. That is, the discriminator is created for each of the condition data sets C1 to Cn that are computation results of the feature quantity.

$$Outi=1(sgni\times(Ci-bi)\geqq 0)$$

$$Outi=-1(sgni\times(Ci-bi)<0) \quad 1$$

Since the preliminary discrimination is not a decisive factor in failure diagnosis, the discrimination at this time is referred to as a weak discrimination process. In this regard, the discriminator configured with the inference engine 113 forms a weak discriminator called a stamp weak discriminator. Further, the control section 36 as the diagnosis unit functions as a preliminary diagnosis result computing unit, that is, a weak discrimination process unit.

The inference engine 113 that functions as the diagnosis unit configures a discriminator that discriminates whether the fixing device 6 is in the normal state or in the abnormal state based on the following Expression (2) using the Outi value.

Specially, the discriminator computes a discrimination index value F as a vote result value of a weighted majority vote by a weighted majority vote expressed in Expression (2) and discriminates that it is in the failure state if the discrimination index value F is equal to or less than zero (0). In Expression (2), i=1 to n. Further, in Expression (2), αi is a values to be multiplied to the feature quantities configuring each condition data Ci in a computation method of the weighted majority vote decided by using the boosting method which will be described later, and the discrimination index value Fi is computed by a sum of multiplied values. In this regard, the inference engine 113 as the diagnosis unit functions as a weighted majority vote computing unit, a weighted majority vote discriminator, or a discrimination index value computing unit.

$$Fi=\Sigma(\alpha i\times Outi) \quad (2)$$

Further, the stamp discriminator as the weak discriminator has a merit of being capable of performing a CPU computation at a high speed, and the sufficient degree of accuracy is obtained in the present method that uses the weighted majority vote. Therefore, the stamp discriminator is very desirable to realize a failure state discrimination technique with high accuracy and at a low cost.

The boosting method will be described. The boosting method is a supervised learning algorithm and is explained in detail in Mathematical science, No. 489, March, 2004, titled "Information geometry of statistical pattern identification". The boosting method is a well-known method, and thus description thereof is omitted.

In order to determine bi, sgni, and αi using the boosting method, condition data that is already known as corresponding to a normal state and condition data that is already known as corresponding to a failure state or a predictive failure state are first created. To this end, a tester having the same configuration as the color image forming device illustrated in FIG. 2 was prepared. Continuous printing of continuously outputting test images was performed using the print tester, and unit time driving loads were sequentially recorded. In order to prevent erroneous detection in which it is determined as the failure state because the unit time driving loads are different depending on a kind of the paper (see FIG. 4), the papers of multiple kinds from a thin paper to a thick paper were used in the experiment.

Trouble or a failure of the fixing device 6 as a target of the present experiment includes functional deterioration or degradation of the oil filter 88 that causes a separation jam due to poor separation of the transfer sheet S from the fixing belt 64 or the pressing roller 63 and function deterioration or degradation of the coating felt 93 that causes locking in meshing between the output gear 86*a* and the driving gear 75 or locking of the motor 86.

Figure 5:
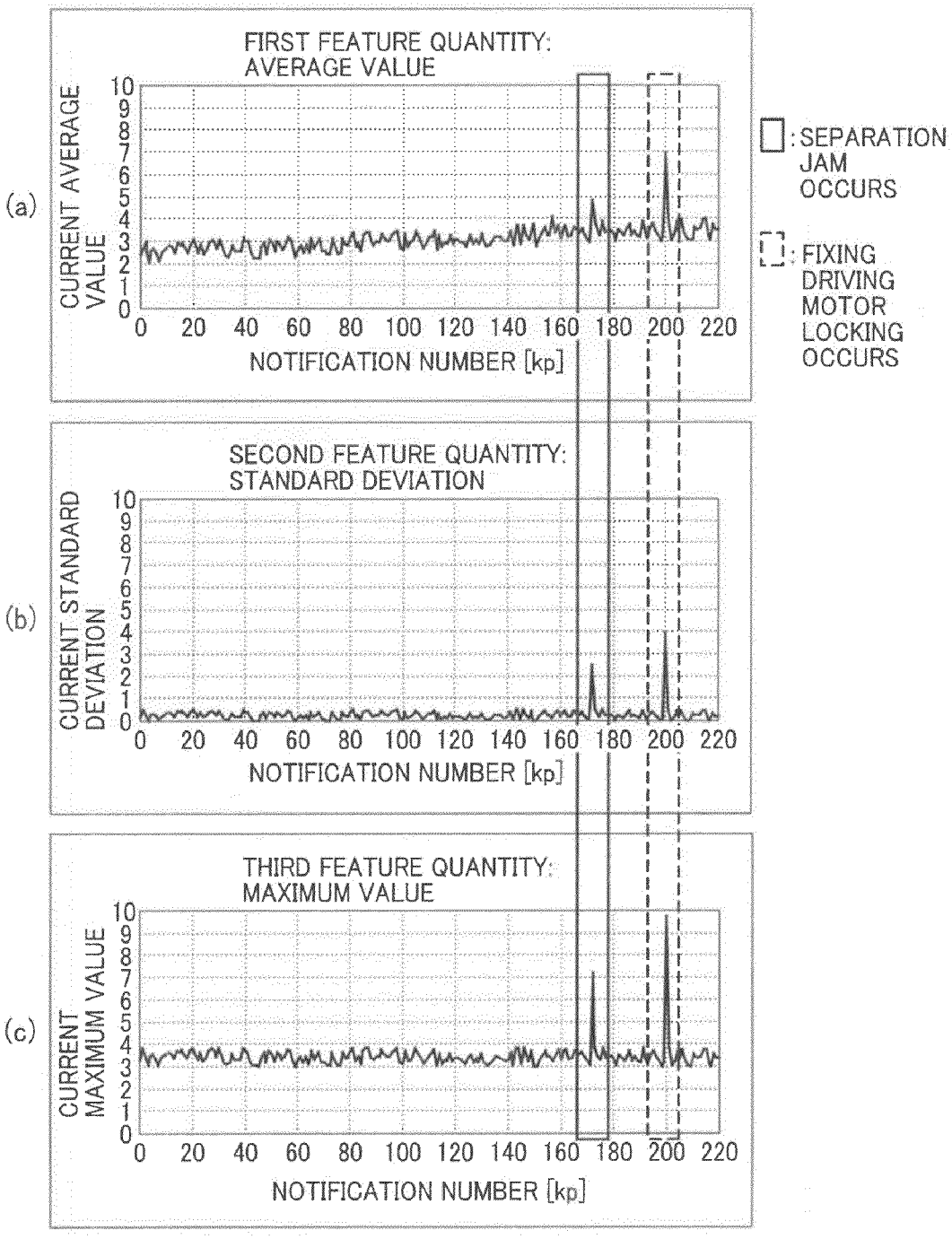
FIG. 5 is a correlation diagram illustrating effectiveness of first to third feature quantities in failure diagnosis of a fixing section.

FIG. 5 illustrates time-series data of the unit time driving load including a first time period in which the separation jam frequently occurs due to deterioration of the oil filter 88 and a second time period in which locking frequently occurs due to deterioration of the coating felt 93. In FIG. 5, a horizontal axis denotes a fixing number (kp), and a vertical axis denotes a feature quantities (driving current/time). A vertical axis of a fragmentary view (a) of FIG. 5 denotes an average value of the unit time driving loads as the first feature quantity, a vertical axis of a fragmentary view (b) of FIG. 5 denotes a standard deviation of the unit time driving loads as the second feature quantity, and a vertical axis of a fragmentary view (c) of FIG. 5 denotes a maximum value of the unit time driving loads as the third feature quantity. The feature quantities are computed and plotted as follows. For example, the average value, the standard deviation, and the maximum value are computed using the unit time driving loads respectively applied in fixing processes of 1 to 10 kp, and the computed values are plotted on a portion of 1 kp. Next, the average value, the standard deviation, and the maximum value are computed using the unit time driving loads respectively applied in fixing processes of 2 to 11 kp, and the computed values are plotted on a portion of 2 kp. Finally, the average value, the standard deviation, and the maximum value are computed using the unit time driving loads respectively applied in fixing processes of 2000 to 2009 kp, and the computed values are plotted on a portion of 2000 kp.

In all of the fragmentary views (a) to (c) of FIG. 5, an area representing an abruptly increased value near 172 kp corresponds to the first time period, and an area representing an abruptly increased value near 200 kp corresponds to the second time period. When the fixing device 6 was observed in the first period, clogging of the oil filter 88 occurred, and the transfer sheet S was wound around the fixing belt 64, frequently causing the separation jam. Further, the coating felt 93 started to be polluted, and the oil supply amount to the fixing belt 64 was scant. When the fixing device 6 was observed in the second period, clogging occurred in the coating felt 93 as well as the oil filter 88, and so the oil supply amount to the fixing belt 64 was much decreased. Thereby, the frictional resistance force between the oil coating roller 91 and the fixing belt 64 increased, so that the motor 86 was in a state in which locking was likely to occur. Accordingly, it can be understood that the first to third feature quantities near 172 kp are suitable to be used for diagnosing a failure of the fixing device 6 caused by deterioration resulting from clogging of the oil filter 88, and the first to third feature quantities near 200 kp are suitable to be used for diagnosing a failure of the fixing device 6 caused by deterioration resulting from clogging of the coating felt 93.

Further, even though the papers of multiple different kinds were used in the initial period, the middle period, and the terminal period of the experiment, in all of F the fragmentary views (a) to (c) of FIG. 5, a feature quantity change did not appear. Therefore, it is understood that it is possible to prevent failure discrimination from being erroneously performed due to a change in a kind of the paper by virtue of using the first to third feature quantities.

In order to apply the condition data including the feature quantities computed by the above-described method to learning by the boosting method, that is, to creating bi, sgni, and αi and to a test of the booting method, that is, confirming the effects of bi, sgni, and αi created, the condition data was randomly sorted into a learning condition data and a test condition data such that each of the both includes the condition data corresponding to failure periods corresponding to the first and second time periods, and feature quantity changes, that is, condition data sets created in this way were used as a set of the learning condition data and a set of the test condition data set, respectively.

Subsequently, in performing leaning by the boosting method, changes of the feature quantities in the learning condition data set was illustrated by a graph having a print number integration value as a horizontal axis. An abnormal period was visually estimated, and a label, that is, Outi corresponding to a period estimated as abnormal in the learning condition data set is given −1 (a failure period), and the other labels, that is, Outi is given 1 (a normal period). Learning by the boosting method was repetitively performed hundred times to decide b1 to b100, sgn1 to sgn100, and α1 to α100. Further, in order to repetitively perform learning by the boosting method hundred times, 100 condition data sets were used for learning.

Figure 6:
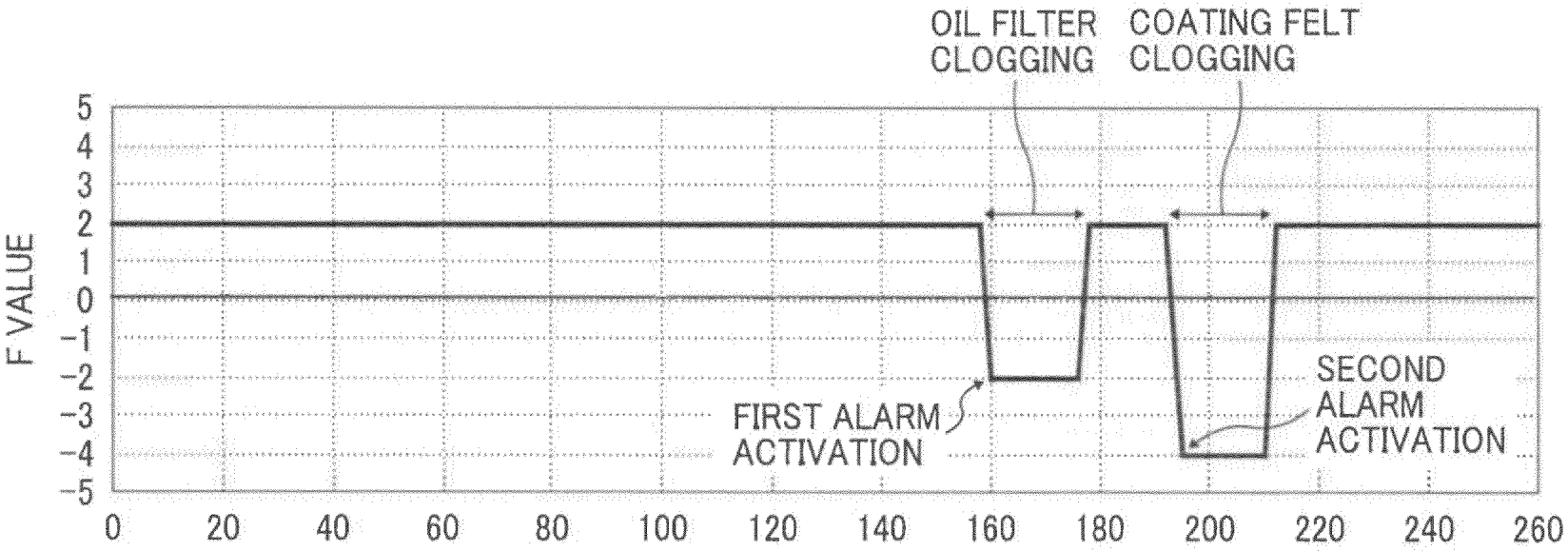
FIG. 6 is a correlation diagram illustrating a result of performing failure diagnosis of a fixing section using first to third feature quantities used to construct a diagnosis unit through the diagnosis unit constructed using the feature quantities.

A result of computing an F value using data used for learning is illustrated in FIG. 6. It was confirmed that, regarding the supervised data to which the labels are attached, learning was appropriately performed, and as a result, a discriminator using the weak discriminators and the weight majority vote, in which only failure periods respectively corresponding to the first and second time periods became minus in the F value, was generated. Next, as a result of verifying, using the test condition data set, the degree of accuracy of the discriminator using the weak discriminators and the weight majority vote, the result was the same as that illustrated in FIG. 6. Similarly to the learning condition data set, 100 condition data sets were used in the test. An output F value of the discriminator that performs a computation using b, sgn, and α which were previously decided became minus in periods corresponding to the first and second time periods, and thus it was confirmed that a failure was diagnosed with the excellent degree of accuracy.

As described above, in the failure diagnosis device 110, the inference engine 113 functions as the discriminator using bi, sgni, and αi previously created as described above, and the failure diagnosis device 110 functions as the above-described other units. Therefore, when the image forming operation is repetitively performed, based on a change of the F value to a minus value, it is possible to estimate or identify a failure of the fixing device 6, particularly, causes of a failure of the fixing device 6 including deterioration of the oil filter 88 and deterioration of the coating felt 93 or to perform failure diagnosis and detection of the fixing device 6 including identification by the estimation.

Generally, a cause of a problem, trouble, or a failure related to the fixing device is various. For this reason, estimating a failure cause is very effective in reducing a time taken for performing repair or maintenance or preventing an unnecessary repair from being performed in a portion other than a failure cause. An application of the invention is very effective because downtime caused by repair is reduced by estimating a cause of a failure of the fixing device 6.

In the present embodiment, estimating a cause of trouble of the fixing device 6 is explained in connection with deterioration of the oil filter 88 and deterioration of the coating felt 93. However, since a cause of a problem or a failure related to the fixing device is various as described above, if the failure diagnosis device 110 is configured to let the inference engine 113 to function as the discriminator using bi, sgni, and $\alpha i$ created as described above and to function as the above-described other units, for further kinds of failure causes, it is possible to perform failure diagnosis including estimation of further kinds of failure causes of the fixing device 6. In this case, it is very effective in preventing an unnecessary repair from being performed in a portion other than a failure cause, and it is more effective in reducing downtime by repair.

Further, by adjusting the values of bi, sgni, and $\alpha i$ created as described above, it is possible to perform failure diagnosis including anticipation or prediction of a failure that will occur soon, that is, a sign of a failure as well as diagnosis of a failure that actually occurred. In this case, in the failure diagnosis device 110, the values of bi, sgni, and $\alpha i$ are set in that manner.

As described above shortly, when the fixing device 6 is diagnosed as having a failure, the inference engine 113 notifies the service engineer or the user of that effect via an electronic mail while identifying the image forming device 100 having the failure. In this regard, the inference engine 113 functions as an alarm transmitting unit. Specially, when the F value computed by the inference engine 113 that functions as the above-described units became minus in periods corresponding to the first time period and the second time period and so the fixing device 6 is diagnosed as having a failure, as illustrated in FIG. 6, the inference engine 113 that functions as the alarm transmitting unit may activate an alarm, in addition to by notifying that the fixing device 6 has the failure while identifying the image forming device 100, by notifying that the oil filter 88 of the fixing device 6 gets deteriorated in the case of corresponding to the first time period, and that the coating felt 93 gets deteriorated in the case of corresponding to the second time period, or alternatively or additionally notifying that it is inferred that a failure or a breakage will occur soon. As a result, downtime taken for maintenance is reduced. A terminal such as a PC that receives an electronic mail or the like, and notifies and informs the service engineer of that effect functions as an informing unit.

In this way, when alarm activation is performed in several stages, it encourages failure restoration of the fixing device 6 to be performed in several stages. In order to discriminate which of the first time period and the second time period is a period in which the F value became minus, a method of discriminating based on whether a fixing number is near 127 kp or near 200 kp may be used. Alternatively, a plurality of threshold values may be used for the F value. For example, a threshold A and a threshold B (A>B) may be used. When the F value is less than only the threshold A, it is determined that the period corresponds to the first time period and, for example, it is recognized as an initial period failure state. In this case, replacement of the oil filter 88 is encouraged. On the other hand, when the F value is also less than the threshold B, it is determined that the period corresponds to the second time period and, for example, it is recognized as a terminal period failure state. In this case, replacement of the coating felt 93 is encouraged. When it is recognized as the initial period failure state, even after that, the fixing device 6 can be continuously used by replacing the oil filter 88. When it is recognized as the terminal period failure state, since it means that the oil supply amount is not improved by replacing only the oil filter 88, the fixing device 6 may be encouraged to be replaced without encouraging the replacement of the coating felt 93. Alternatively, replacement of the coating felt 93 may be encouraged. In this case, even after that, the fixing device 6 may be continuously used. When alarm activation is performed in several stages, it is possible to remarkably improve economic and environmental merits and reduce downtime. However, "the terminal period failure state", alarm activation may be performed once at a time corresponding to "the terminal period failure state" to encourage replacement of the oil filter 88 and the coating felt 93. Even in this case, the fixing device 6 is allowed to be continuously used. Even when alarm activation is performed once, replacement of the fixing device 6 may be encouraged.

Further, the function as the alarm transmitting unit may be given to another part of the failure diagnosis device 110 other than the inference engine 113, for example, the data collector 111 having the communication function. A notification of that effect to the user may be displayed and informed on the LCD device 43 of the corresponding image forming device 100 by the inference engine 113 or the data collector 111 as the alarm transmitting unit via the Internet 130. When the corresponding image forming device 100 has an alarm notification device or the like that generates a sound such as a voice, the alarm notification device may be used to inform that effect in a similar manner, and the above-described methods may be appropriately combined. In the case where the image forming device 100 performs such informing, the LCD device 43 or the like functions as the informing unit.

Execution of the operation, the function, or the failure diagnosis method of the failure diagnosis device 110 as described above may be realized by executing a failure diagnosis program that is, a program for performing the failure diagnosis method stored in the memory of the system controller 114. In this regard, the system controller 114 functions as a failure diagnosis program storage unit.

The failure diagnosis program and a computer-usable medium for recording the failure diagnosis program are described here. The program is stored in the memory of the system controller 114 and executed by the CPU of the system controller 114 or the CPU of the inference engine 113. The memory corresponds to the computer-usable medium. The computer-usable medium for recording the program may include any of a semiconductor medium (for example, ROM or non-volatile memory), an optical medium (for example, DVD, MO, MD, or CD-R), or a magnetic medium (for example, hard disk, magnetic tape, or flexible disk). The recording medium also includes a storage device such as a hard disk of a sever computer in an external information input device that stores the program when the program is downloaded and distributed through a user computer or the like connected to a network such as the Internet or the LAN. An execution aspect of the program includes a case in which part or all of actual processing is performed by an operating system or the like based on an instruction of the loaded program and the above-described method is execute by the processing.

In this regard, a recording medium such as a semiconductor medium in the PC 140 corresponds to a computer-usable medium. An operator who operates the PC 140 can perform update, maintenance or the like of the failure diagnosis device 110, for example, by appropriately browsing the driving load stored in the state database 112 and newly generating, correcting, and deleting the inference engine 113 on the corresponding image forming device 100.

The failure diagnosis device 110 is connected to a plurality of image forming devices 100 to be able to perform failure diagnosis for each of the image forming devices 100 as described above. Therefore, it is possible to surely improve a data generation method including a computation method of each feature quantity described above or discrimination constants such as bi, sgni, and αi, which are used in performing failure diagnosis, in an integrated manner. As a result, it is possible to easily and securely improve the quality of failure diagnosis. Further, since the boosting method having a relatively small number of steps is used as described above, even though an amount of data related to the driving load or the like accumulated in the state database 112 becomes huge, it is possible to timely perform diagnosis at a high speed.

Figure 7:
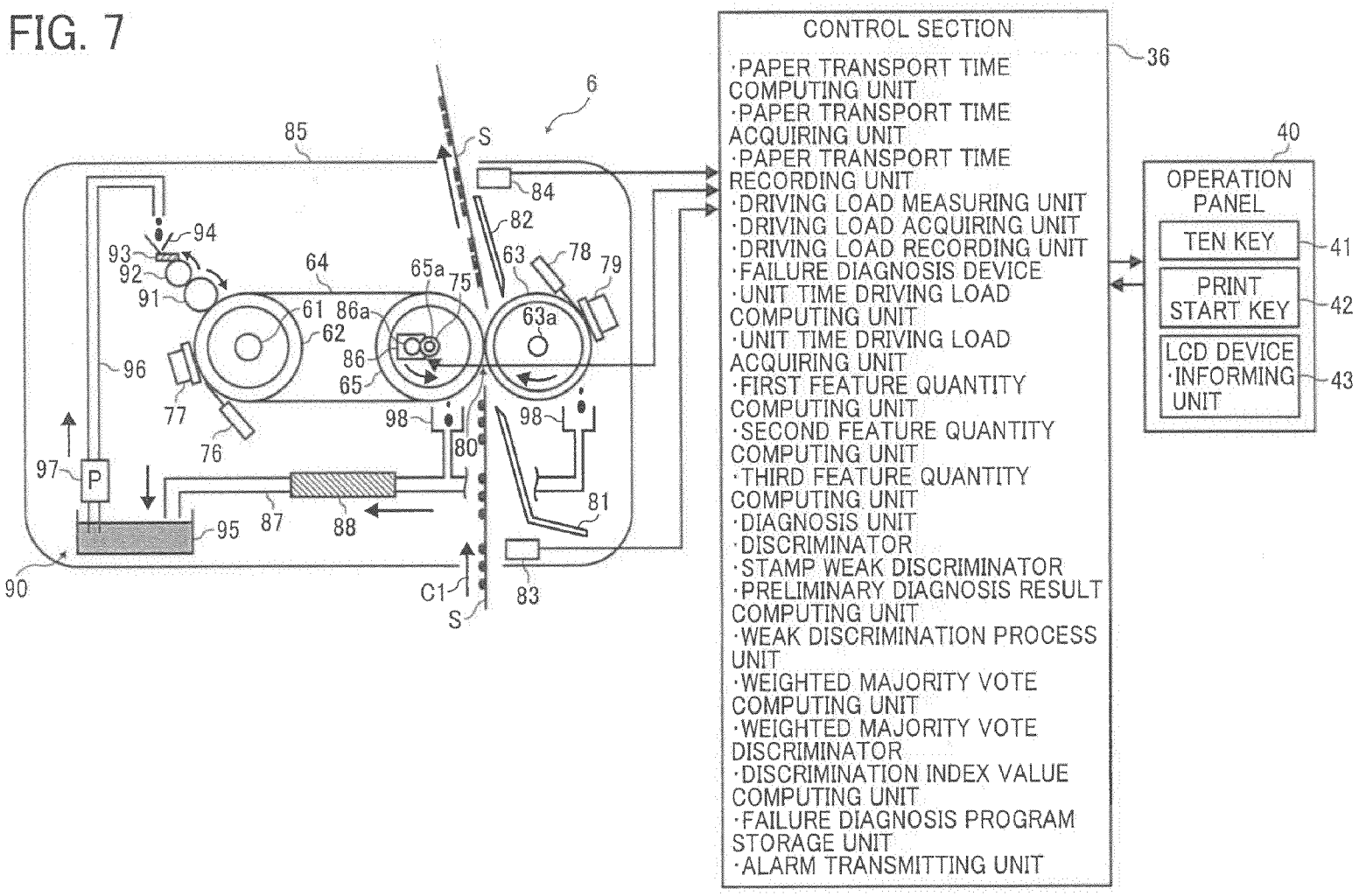
FIG. 7 is a control block diagram illustrating part of an image forming device including a failure diagnosis device according to the invention.

Since failure diagnosis is performed by processing having a relative small number of steps, the function of the failure diagnosis device 110 may be implemented in the image forming device 100 described above, for example, in the control section 36. In this case, the image forming device 100 configures the failure diagnosis system 1. A configuration example in which the control section 36 in the image forming device 100 has the same function as the failure diagnosis device 110 is illustrated in FIG. 7. In the configuration example, as illustrated in FIG. 7, the control section 36 has the respective units and functions of the respective discriminators disposed in the failure diagnosis device 110, particularly, in the inference engine 113 such as the diagnosis unit, the failure diagnosis program storage unit, and the alarm transmitting unit. Further, the control section 36 as the failure diagnosis device further includes functions as the paper transport time computing unit, the paper transport time acquiring unit, the paper transport time recording unit, the driving load measuring unit, the driving load acquiring unit, the driving load recording unit, the unit time driving load computing unit, and the unit time driving load recording unit. Further, in order to execute the failure diagnosis method or the failure diagnosis program, the paper transport time computing unit, the paper transport time acquiring unit, the paper transport time recording unit, the driving load acquiring unit, the driving load recording unit, the unit time driving load computing unit, and the unit time driving load recording unit are used.

Further, in the configuration example, when the fixing device 6 is diagnosed as having a failure, the LCD device 43 functions as the informing unit for displaying and informing that effect to the user. Specially, when the F value computed by the control section 36 that functions as the failure diagnosis device became minus in periods corresponding to the first time period and the second time period and so the fixing device 6 is diagnosed as having a failure, as illustrated in FIG. 6, the LCD device 43 that functions as the informing unit activates an alarm under control of the control section 36 by notifying, in addition to that the fixing device 6 has the failure, that the oil filter 88 of the fixing device 6 gets deteriorated in the case of corresponding to the first time period, and that the coating felt 93 gets deteriorated in the case of corresponding to the second time period, or alternatively or additionally displaying that it is inferred that such a failure or a breakage will occur soon. Thereby, downtime taken for repair or maintenance is reduced as described above. The informing unit is not limited to the LCD device 43. When the alarm notification device that generates a sound such as a voice is disposed in the image forming device 100, the alarm notification device may be used to inform that effect. When the image forming device 100 has the communication function such as the LAN 120 and the Internet 130, the communication function may be used to transmit an electronic mail or the like to the service engineer or the user. The above-described methods may be appropriately combined.

The exemplary embodiments of the invention have been described, but the invention is not limited to the specific embodiments. Various modification and changes can be made to the invention within the technical spirit of the invention as set forth in claims unless specially limited in the above description.

For example, as the feature quantity used for failure diagnosis, in the above-described embodiment, the first to third feature quantities are used, since higher degree of diagnosis accuracy is obtained than the first and second quantities are used. However, as the feature quantity used for failure diagnosis, only the first and second feature quantities may be used, and another value such as a statistical value may be used as the third feature quantity. Further, in addition to the first to third feature quantities, another value such as statistical value may be used.

In the configuration example illustrated in FIG. 1, the paper transport time acquired by the paper transport time acquiring unit and the driving load acquired by the driving load acquiring unit may be transmitted to the failure diagnosis device to compute and record the unit time driving load in real time. In this case, the paper transport time recording unit and the driving load recording unit at the image forming device side may be omitted.

The releasing agent supply unit may be disposed at the fixing unit side as in the above-described embodiment or may be disposed on the main body side of the image forming device instead of the fixing unit side. Selecting one from these configurations may be performed depending on an arrangement position of a constitution of eliminating an estimated cause of a failure and convenience of its replacement, repair, and other maintenances.

The fixing device may be another fixing device employing another method such as a roller fixing system other than a fixing device employing a belt s system as in the fixing device 6.

The invention may be similarly applied to an image forming device of a so-called one drum system that obtains a color image by sequentially forming toner images of respective colors on one photosensitive element and sequentially superimposing the toner images of respective colors, instead of the image forming device of a so-called tandem method but.

The image forming device may be not a complex machine of a copy machine, a printer, and a facsimile but a single body thereof. Further, the image forming device may be a complex machine of another combination such as a complex machine of a copy machine and a printer.

A direct transfer system in which toner images of respective colors are directly transferred on a transfer material without using an intermediate transfer body may be employed in any type of an image forming device. In this case, toner images on a plurality of image carriers are directly transferred onto a sheet.

The effects described in the embodiments of the invention are merely enumeration of most desirable effects achieved by the invention. The effects of the invention are not limited to those described in the embodiments of the invention.

According to the invention, since failure diagnosis performed using the driving load of the fixing section includes estimation of a cause of a failure, it is possible to make repair or maintenance easy when failure diagnosis is performed. Further, the failure diagnosis device of high reliability in which downtime can be reduced can be provided.

According to the invention, the third feature quantity as well as the first feature quantity and the second feature quantity may be used in failure diagnosis performed using the driving load of the fixing section, and thereby the degree of accuracy of failure diagnosis is further improved. Therefore, it is possible to make repair or maintenance further easier when failure diagnosis is performed. Further, the failure diagnosis device of high reliability in which downtime can be further reduced can be provided.

According to the invention, failure diagnosis performed using the driving load of the fixing section may include estimation of a plurality of causes of the failure, and when diagnosing the failure due to one of the causes, perform an output for informing the failure and the one of the causes. In this case, it is possible to make repair or maintenance very easy when failure diagnosis is performed. Further, the failure diagnosis device of extremely high reliability in which downtime can be largely reduced can be provided.

According to the invention, failure diagnosis performed using the driving load of the fixing section may include estimation of the occurrence of poor feeding of the releasing agent to the fixing member that is a cause of the failure. In this case, since it is possible to recognize that poor feeding of the releasing agent to the fixing member occurred, repair can be performed at a pinpoint without replacing the whole fixing section. Therefore, it is possible to make repair or maintenance easier when failure diagnosis is performed. Further, the failure diagnosis device of high reliability in which downtime can be reduced can be provided.

According to the invention, failure diagnosis performed using the driving load of the fixing section may include estimation of the occurrence of poor feeding of the releasing agent to the fixing member resulting from deterioration of the supply member that is a cause of the failure. In this case, since it is possible to recognize that poor feeding of the releasing agent to the fixing member occurred due to deterioration of the supply member, repair can be performed at a pinpoint by replacing the supply member without replacing the whole fixing section. Therefore, it is possible to make repair or maintenance easier when failure diagnosis is performed. Further, the failure diagnosis device of high reliability in which downtime can be reduced can be provided.

According to the invention, failure diagnosis performed using the driving load of the fixing section may include estimation of the occurrence of poor feeding of the releasing agent to the fixing member resulting from deterioration of the filtration member that is a cause of the failure. In this case, since it is possible to recognize that poor feeding of the releasing agent to the fixing member occurred due to deterioration of the filtration member, repair can be performed at a pinpoint by replacing the filtration member without replacing the whole fixing section. Therefore, it is possible to make repair or maintenance easier when failure diagnosis is performed. Further, the failure diagnosis device of high reliability in which downtime can be reduced can be provided.

According to the invention, failure diagnosis may be performed using the driving current of the fixing section as the driving load of the fixing section. In this case, it is relatively easy to acquire the driving load of the fixing section.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A failure diagnosis device for a failure of a fixing section of an image forming device, comprising:

a first feature quantity computing unit that computes a first feature quantity representing an average of a plurality of driving loads of the fixing section recorded by a driving load recording unit that records the driving load acquired by a driving load acquiring unit that acquires the driving load;

a second feature quantity computing unit that computes a second feature quantity representing a deviation of the plurality of the driving loads recorded by the driving load recording unit;

a diagnosis unit that performs failure diagnosis including estimation of a cause of the failure of the fixing section using at least the first feature quantity computed by the first feature quantity computing unit and the second feature quantity computed by the second feature quantity computing unit; and a third feature quantity computing unit that computes a third feature quantity representing a maximum value among the plurality of the driving loads recorded by the driving load recording unit, wherein the diagnosis unit performs failure diagnosis using at least the first feature quantity computed by the first feature quantity computing unit, the second feature quantity computed by the second feature quantity computing unit, and the third feature quantity computed by the third feature quantity computing unit.

2. A failure diagnosis device for a failure of a fixing section of an image forming device, comprising:

a first feature quantity computing unit that computes a first feature quantity representing an average of a plurality of driving loads of the fixing section recorded by a driving load recording unit that records the driving load acquired by a driving load acquiring unit that acquires the driving load;

a second feature quantity computing unit that computes a second feature quantity representing a deviation of the plurality of the driving loads recorded by the driving load recording unit; and a diagnosis unit that performs failure diagnosis including estimation of a cause of the failure of the fixing section using at least the first feature quantity computed by the first feature quantity computing unit and the second feature quantity computed by the second feature quantity computing unit, wherein the diagnosis unit includes stamp weak discriminators that are created using a boosting method and computes a preliminary diagnosis result of the failure.

3. The failure diagnosis device according to claim 2, wherein the diagnosis unit includes a weighted majority vote computing unit that diagnoses the failure by performing a weighted majority vote using the diagnosis result computed by the stamp weak discriminators.

4. The failure diagnosis device according to claim 1, wherein the diagnosis unit estimates a plurality of causes of the failure of the fixing section and, when diagnosing the failure due to one of the causes, performs an output for informing the failure and the one of the causes.

5. A failure diagnosis device for a failure of a fixing section of an image forming device, comprising:

a first feature quantity computing unit that computes a first feature quantity representing an average of a plurality of driving loads of the fixing section recorded by a driving load recording unit that records the driving load acquired by a driving load acquiring unit that acquires the driving load;

a second feature quantity computing unit that computes a second feature quantity representing a deviation of the plurality of the driving loads recorded by the driving load recording unit; and a diagnosis unit that performs failure diagnosis including estimation of a cause of the failure of the fixing section using at least the first feature quantity computed by the first feature quantity computing unit and the second feature quantity computed by the second feature quantity computing unit, wherein the failure diagnosed by the diagnosis unit relates to poor feeding of a releasing agent to a fixing member that is disposed in the fixing section and abuts on a recording medium.

6. The failure diagnosis device according to claim 5, wherein the cause of the failure of the fixing section estimated by the diagnosis unit includes a cause related to deterioration of a supply member that supplies the releasing agent to the fixing member.

7. The failure diagnosis device according to claim 5, wherein the cause of the failure of the fixing section estimated by the diagnosis unit includes a cause related to deterioration of a filtration member that filters the releasing agent supplied to the fixing member.

8. The failure diagnosis device according to claim 1, wherein the driving load acquiring unit acquires the driving load based on a driving current of the fixing section.

9. An image forming device, comprising:

the driving load acquiring unit, wherein the failure is diagnosed by the failure diagnosis device recited in claim 1.

* * * * *